US008230982B2

(12) United States Patent
Friedman et al.

(10) Patent No.: US 8,230,982 B2
(45) Date of Patent: Jul. 31, 2012

(54) ELEVATOR CAB DESIGN

(76) Inventors: Harold S. Friedman, New York, NY (US); Jeffrey Friedman, New York, NY (US); Angelo Palmieri, Bronx, NY (US)

( * ) Notice: Subject to any disclaimer, the term of this patent is extended or adjusted under 35 U.S.C. 154(b) by 1662 days.

(21) Appl. No.: 10/748,440

(22) Filed: Dec. 30, 2003

(65) Prior Publication Data

US 2005/0145443 A1 Jul. 7, 2005

(51) Int. Cl.

| | |
|---|---|
| ***B66B 11/02*** | (2006.01) |
| ***E04B 1/38*** | (2006.01) |
| ***E04B 1/70*** | (2006.01) |
| ***E04C 2/32*** | (2006.01) |

(52) U.S. Cl. ..... 187/401; 52/281; 52/282.1; 52/284; 52/302.1

(58) Field of Classification Search ..... 187/401; 52/257–272, 281, 281.1–281.3, 284, 288.1, 52/289, 302.1, 311.1, 311.2, 312; *B66B 11/02*
See application file for complete search history.

(56) References Cited

U.S. PATENT DOCUMENTS

| | | | | | |
|---|---|---|---|---|---|
| 2,065,920 | A | * | 12/1936 | Clark | 52/275 |
| 2,176,980 | A | * | 10/1939 | Sherron | 52/22 |
| 2,206,075 | A | * | 7/1940 | Campbell | 52/285.2 |
| 2,897,620 | A | * | 8/1959 | Fitzgerald | 52/796.1 |
| 3,381,438 | A | * | 5/1968 | Bohnsack | 52/481.2 |
| 3,458,963 | A | * | 8/1969 | Klein | 52/287.1 |
| 3,550,340 | A | * | 12/1970 | Klein | 52/312 |
| 3,556,583 | A | * | 1/1971 | Ellard, J. | 296/191 |
| 3,589,083 | A | * | 6/1971 | Scalfani, Jr. | 52/27 |
| 3,631,942 | A | * | 1/1972 | Brounn | 187/401 |
| 3,702,044 | A | * | 11/1972 | Balinski | 52/30 |
| 4,270,321 | A | * | 6/1981 | Fisher | 52/97 |
| 4,635,756 | A | * | 1/1987 | Sherwood et al. | 187/401 |
| 4,700,809 | A | * | 10/1987 | Lazar | 187/401 |
| 4,967,532 | A | * | 11/1990 | Castle et al. | 52/599 |
| 5,237,790 | A | * | 8/1993 | Smalley | 52/282.3 |
| 5,454,449 | A | * | 10/1995 | Mäkimattila et al. | 187/401 |
| 6,145,630 | A | * | 11/2000 | Friedman et al. | 187/313 |

(Continued)

FOREIGN PATENT DOCUMENTS

EP 479238 A2 * 4/1992

(Continued)

*Primary Examiner* — Michael Mansen
*Assistant Examiner* — Stefan Kruer
(74) *Attorney, Agent, or Firm* — Douglas C. Wyatt

(57) ABSTRACT

New elevator cab construction and reconstruction of old elevator cabs are frequently presented with the problem of increasing the interior size of the elevator cab in an elevator shaft of limited size. This invention relates to an elevator cab design providing a novel way of increasing internal cab size of a standard elevator cab while still retaining decorative design features by having removable decorative panels. The elevator cab is constructed of the normal elements, namely, a platform, a ceiling, cab shell walls, stiffeners and corner stiffener risers. The cab shell walls have a base and transom and shell panels there between designed to overlap one another so as to be readily attached by spot welding or adhesive. The stiffeners are hat-shaped elongated sections typically of stainless steel that are attached to the inside of the shell panels. The stiffeners may also be formed by hat-shaped ribs formed in the shell panels. Removable decorative panels of approximately the same thickness as the stiffeners are hung directly on the interior of shell panels between the stiffeners. Advantageously, the use of the stiffeners on the inside of the shell panels and the mounting of the decorative panels on the shell panel between the stiffeners increases the internal width and depth of the elevator cab.

4 Claims, 3 Drawing Sheets

U.S. PATENT DOCUMENTS

| | | | | |
|---|---|---|---|---|
| 6,223,488 | B1 * | 5/2001 | Pelfrey et al. | 52/302.1 |
| 6,564,908 | B2 * | 5/2003 | Sanchez et al. | 187/414 |
| 6,631,589 | B1 * | 10/2003 | Friedman et al. | 52/30 |
| 6,988,592 | B2 * | 1/2006 | Watabe et al. | 187/313 |

FOREIGN PATENT DOCUMENTS

| | | | | |
|---|---|---|---|---|
| EP | 584047 | A1 | * | 2/1994 |
| EP | 788996 | A2 | * | 8/1997 |
| FR | 2671835 | A3 | * | 7/1992 |
| JP | 01294188 | A | * | 11/1989 |
| JP | 03162388 | A | * | 7/1991 |
| JP | 03192088 | A | * | 8/1991 |
| JP | 05330765 | A | * | 12/1993 |
| JP | 06001569 | A | * | 1/1994 |
| JP | 06064872 | A | * | 3/1994 |
| JP | 06144748 | A | * | 5/1994 |
| JP | 07-33365 | A | * | 2/1995 |
| JP | 11349260 | A | * | 12/1999 |
| JP | 2000-233881 | A | * | 8/2000 |
| JP | 2002-265171 | A | * | 9/2002 |
| WO | 97/09265 | | * | 3/1997 |

* cited by examiner

ELEVATOR CAB DESIGN

FIELD OF INVENTION

New elevator cab construction and reconstruction of old elevator cabs are frequently presented with the problem of increasing the interior size of the elevator in an elevator shaft of limited size. The present invention relates to a novel way of increasing interior elevator cab size of the elevator cab and still retain the important design feature of having removable decorative panels mounted on elevator interior shell walls.

BACKGROUND OF THE INVENTION

Traditionally, elevator cab design requires walls forming the interior of the elevator in the form of shell panels mounted between a platform and ceiling. Further the shell panels are traditionally stiffened by vertical stiffeners on the exterior of the shell that extend toward the elevator shaft. Decorative panels are mounted on the inside of the shell panels so as to extend into the interior of the elevator cab. Thus the wall thickness will be the sum of the shell wall and the depth of the exterior vertical stiffeners plus the thickness of a decorative panel mounted on the shell. The standard removable decorative panels mounted on the inside of the cab extend into the interior of the cab from the shell as much as one inch or more for each wall so the cab size is reduced by both length and width.

In order to make room for passenger needs an increase in width and depth of the elevator cab can make a significant improvement in the design of new elevators or redesigned old elevators located in limited elevator shaft space.

SUMMARY OF THE INVENTION

The elevator cab design of this invention presents a novel way of increasing interior cab size of the elevator cabs while still retaining the important design feature of having removable decorative interior panels.

New elevator cab construction and reconstruction of old elevator cabs are frequently presented with the problem of increasing the interior size of the elevator cab in an elevator shaft of limited size to accommodate passenger needs. Small increases in length and width of the interior of elevator cabs allows more room for convenient accommodation of wheel chairs and other passenger needs.

This invention relates to an elevator cab design providing a novel way of increasing internal cab size of a standard elevator cab while still retaining decorative design features of removable decorative interior panels. The elevator cab is constructed on a platform. The cab includes cab shell walls, a ceiling, stiffeners, corner stiffeners and doors. The cab shell walls have a base and transom and shell panels therebetween designed to overlap one another so as to be readily attached by spot welding or adhesive. The stiffeners may be hat-shaped or C-shaped elongated sections typically of stainless steel forming a ventilation channel that is attached vertically or horizontally to the inside of the shell panels. The stiffeners provide a channel for ventilation of the elevator cab interior. In an alternate construction, the stiffeners may also be formed as elongated ribs in the material of the shell panels. Removable decorative panels of approximately the same thickness as the hat-shaped stiffeners are hung directly on the shell panels between the stiffeners. Advantageously, the use of the stiffeners on the inside of the shell panels and the mounting of the decorative panels on the shell panel between the stiffeners increases the internal width and depth of the elevator cab interior. By placing the stiffeners on the inside of the cab, they also serve to decorate the space between the panels ("reveals"). The stiffeners can be clad with decorative plastic, metal or other material.

The elevator cab design for increasing interior cab size of elevator cab includes:

(a) shell panels forming the interior walls of the cab with a ceiling and platform, (b) stiffeners on the interior of the shell panels to provide suitable stiffening and the stiffeners and adjacent shell panels may have ventilation openings, (c) vertical corner trim stiffeners in the corners of the cab supporting the shell panels, (d) decorative panels mounted on the shell panels on the interior of said cab mounted adjacent the stiffeners.

The elevator cab may have decorative panels which are approximately the same thickness as the stiffeners and the stiffeners may be hat-shaped. In addition the shell panels have openings to the elevator shaft adjacent the stiffeners to provide ventilation through the channel provided by the hat-shaped stiffeners. The shell panels forming the interior walls of the elevator cab are attached to the ceiling and platform by a base and transom which are offset inwardly from the vertical plane of the shell panels toward the cab interior. The stiffeners may be elongated hat-shaped strips or they may be formed in the shell panel material as elongated hat-shaped portions forming a shape that provides a stiff elongated support member that also acts as a ventilation channel.

The elevator cab of this invention has the following benefits:

1. Increases the inside width and depth of an elevator cab over the standard removable panel design,
2. Maximizes the inside cab height regardless of the placement of the elevator sling crosshead beam and gussets,
3. Reduces the cost of elevator cab construction by using structural members as decorative pieces in the base and transom riser,
4. Provides a system for increasing ventilation,
5. Sound attenuation.

The walls of the elevator cab of this invention contains the normal four elements of an elevator cab, namely, ceiling, shell walls, decorative panels and stiffeners.

Shell Construction

The base and shell panel, and the shell panel and transom riser, are designed to overlap one another so spot welding or high strength adhesives can fasten them together. The base is formed as an elongated horizontal panel in a square-corner C-shape with one additional flange extending perpendicularly to one of the legs of the C-shaped base for attachment to the shell panel. The bottom flange of the base is attached to the platform. The shell panel is flat and the transom riser is shaped like the base but deeper and attached to the ceiling.

In assembly, the base is at the bottom with the open side of the C facing towards the shaft and the additional flange pointing up. The bottom of the shell panel overlaps the additional flange of the base. The transom riser is at the top and its additional flange extends downwardly to overlap the top of the shell panel. The seams where the panels overlap are horizontal.

The stiffeners may be vertical or horizontal channel-shaped sections, typically of stainless steel, which are applied vertically or horizontally to the inside of the assembled panels to form the side walls and the front and rear walls depending on the position of the elevator doors. The stiffeners including the corner stiffeners have ventilation openings that communicate with the elevator shaft. The channel shape may be formed by a V-shaped or C-shaped, U-shaped or hat-shaped formation to provide stiffness and a channel for ventilation. There may be as few as one and as many as four or more stiffeners per wall, depending on the size of the cab and the desired appearance. Vertical stiffeners overlap the base, the shell panel and the transom riser and are fastened to each to make the assembled wall rigid. Horizontal stiffeners provide a ventilation channel to the vertical corner stiffeners. The shape of the panels and the use of the stiffeners on the inside maximize the internal width and depth. The vertical corner stiffeners may have openings to provide additional ventilation to the elevator shaft.

Shell Preparation

During fabrication of the base and shell panels, holes are punched in a line on the shell panel where the stiffeners will be placed to allow ventilation. Low-profile panel clips are attached to the shell panel where the removable panels will be hung.

Holes are punched in the transom riser to provide an opening for the lighting, additional ventilation, and for fastening the ceiling to the transom riser. The top leg of the C-shaped base that is parallel to the floor is also perforated to allow ventilation.

Panel Mounting

Removable decorative panels can be of any code-compliant material, including plastic laminate, wood veneer, stone, metal or glass. The panels have low-profile mounting clips or are otherwise prepared to hang from the shell wall. The panels are oriented to fit between the stiffeners. The thickness of the decorative panels is approximately the same as the thickness of the stiffeners whereby the interior dimensions of the cab is advantageously increased.

The face of the stiffeners exposed to the inside of the cab are provided with a decorative finish such as paint, or made of a decorative metal such as stainless steel. One or more of the removable panels can be drilled for providing a handrail, which is mounted on posts to allow the handrail to be removable from inside the cab.

Lighting

The C shape of the transom riser is bent deeper than the thickness of the shell panels and removable decorative panels to present an inverted stepped cove. Light fixtures are then mounted outside the cab inside the C-shaped riser. Risers have lenses placed in holes punched in the riser to allow the light to come through. The lenses are removable to allow the fixtures and bulbs to be serviced from the inside of the cab. One or more risers may have a register opening or grille to provide ventilation at the top of the cab.

Ceiling

Because lighting is provided on the risers, the ceiling of the cab does not need to have any light fixtures. The only component the ceiling has to have is the top exit hatch (mandatory by code). This design makes light fixtures mounted to the inside of the cab ceiling optional, thereby maximizing the internal height. By also eliminating or minimizing the number of devices mounted on the interior of the ceiling, this advantageous design allows for the maximum height under the crosshead beam and gussets of the cab sling.

BRIEF DESCRIPTION OF THE DRAWINGS

FIG. 2*a* shows a top view of the stiffener,

DETAILED DESCRIPTION OF THE INVENTION

Figure 1:
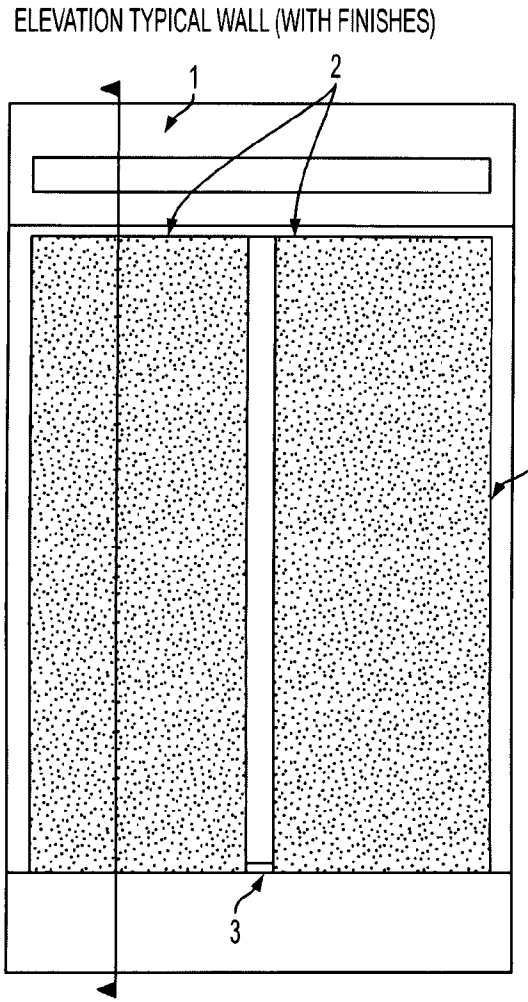
FIG. 1 is an elevation view of one wall of a typical elevator cab using the present invention.
Figure 2:
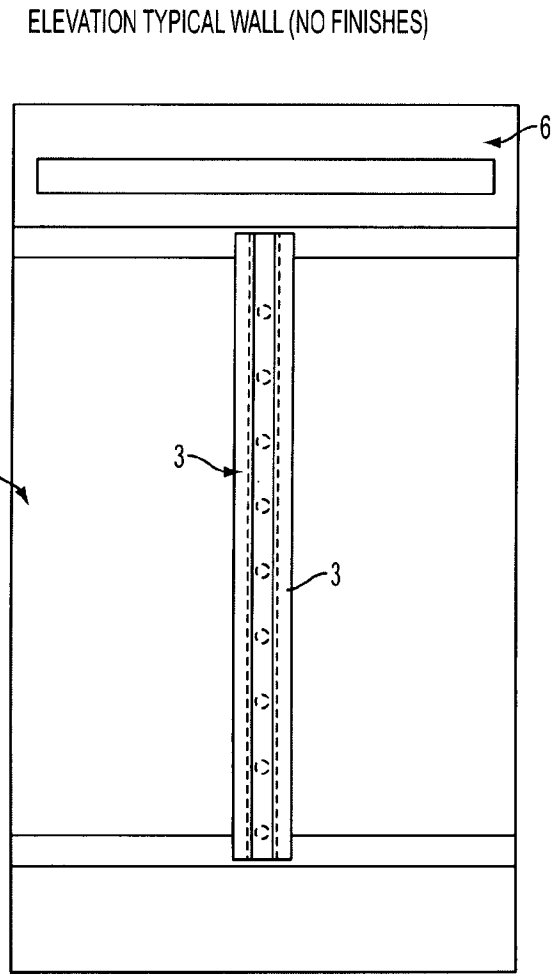
FIG. 2 is an elevation view similar to FIG. 1 except the decorative panels have been removed to illustrate a vertical wall stiffener mounted on the shell panel.
Figure 3:
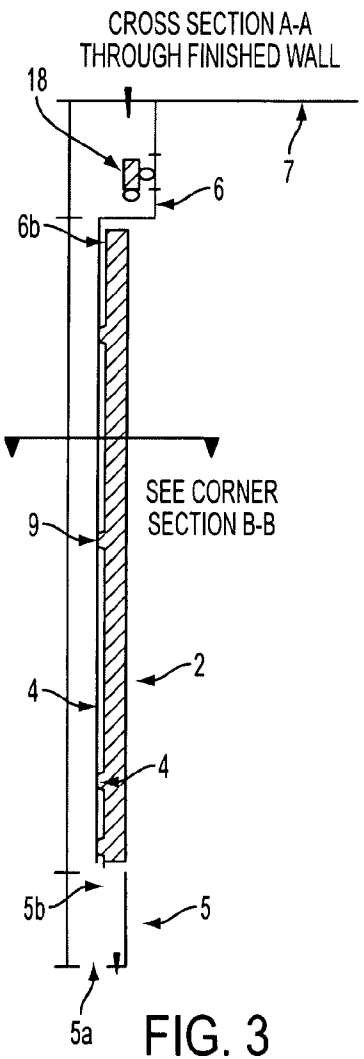
FIG. 3 is a cross section of FIG. 1 showing the interior decorative panel mounted directly on the shell panel.

FIG. 1 shows a cab wall shell 1 with a decorative panel 2 mounted thereon adjacent to the vertical stiffener 3 with a channel or hat-shaped cross section. In an alternated embodiment, the stiffeners 3 may also be horizontally mounted with the decorative panels 2 mounted above and below. As shown in FIGS. 2 and 3 the cab wall 1 has a shell panel 4 and a base 5 fastened to the cab platform 5*a*. The cab wall 1 has shell panel 4 extending vertically upward from the shell base 5. At the upper portion of the shell panel 4 a transom riser 6 extends toward and is attached to the ceiling 7. The channel shape may be formed by a V-shaped or C-shaped, U-shaped or hat-shaped formation to provide stiffness and a channel for ventilation.

Figure 4:
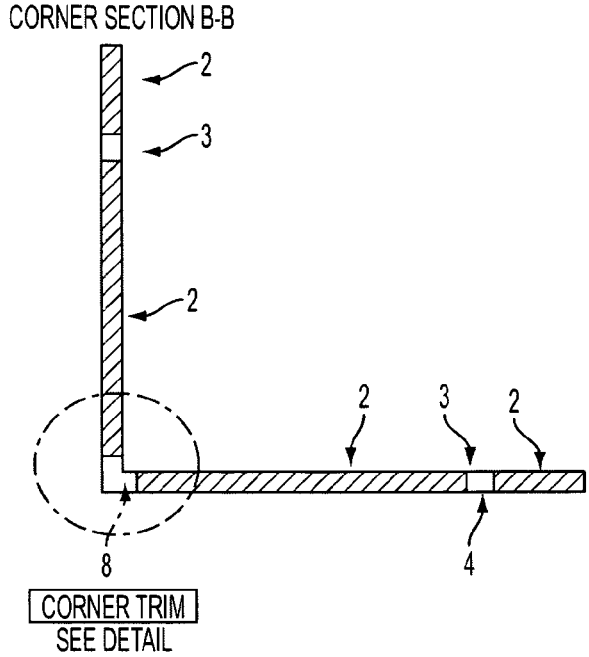
FIG. 4 is a top view illustrating details of the corner stiffener trim and wall stiffeners with interior wall panels mounted therebetween.
Figure 5:
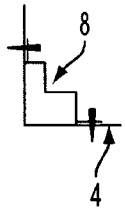
FIG. 5 is a diagram of the corner trim attached to the shell panels.

As shown in FIG. 4 there is a corner trim 8 stiffener which is mounted in each corner of the cab shell 1 which also provides a channel for ventilation air in the same manner as the stiffeners 3.

Figure 7:
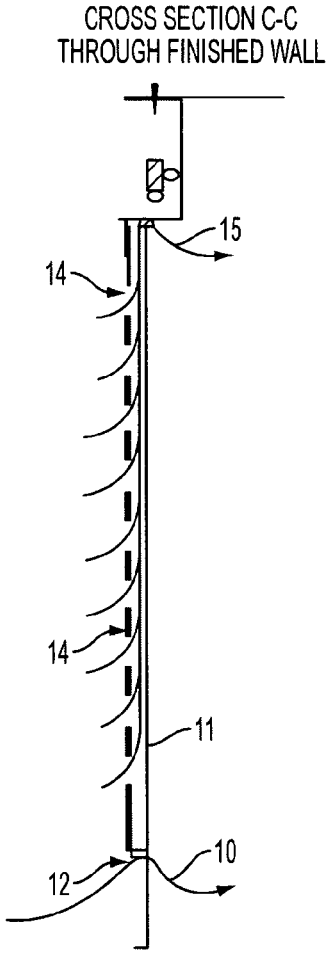
FIG. 7 is a cross section of the wall of FIG. 1 illustrating the ventilation path through the openings in the shell panel communicating with the elevator shaft and up through the interior channel provided by the hat-shaped wall stiffener.
Figure 8:
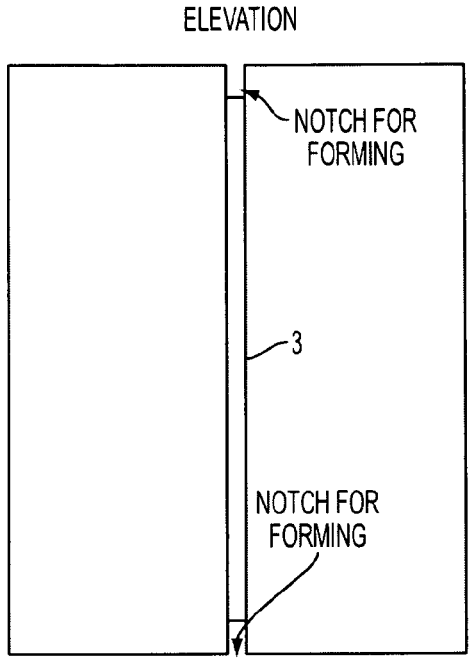
FIG. 8 shows an alternate construction wherein the stiffener is formed in the material of the shell panel wall.
Figure 8A:
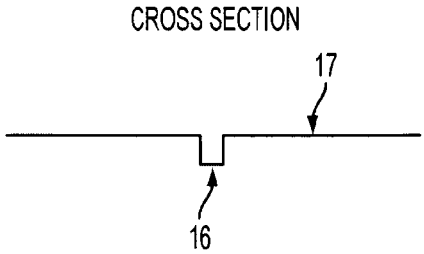
FIG. 8*a* is a top view of the shell panel wall of FIG. 7.

FIG. 7 shows how the channel-shaped stiffener 3 provides for ventilation from outside the cab to inside the cab from the elevator shaft 11. Arrow 10 shows how the air may flow for ventilation from outside the cab shell 1 from the elevator shaft 11 through horizontal openings 12 in the base 5.

In addition, ventilation openings 14 are provided in shell panel 4 adjacent to the vertical stiffeners 3 so that air may flow through the channel provided by the channel-shaped vertical stiffeners 3. The corner trim stiffener 8 also allows air ventilation path to the elevator shaft 111 through similar openings. In FIG. 7, arrow 15 shows how the air may flow through the ventilation opening 14 in the shell panels 4 and through the channel provided by the hat-shaped stiffeners 3 to the elevator shaft area 11.

The base 5 and shell panel 4, and the shell panel 4 and transom riser 6, are designed to overlap one another so spot welding or high strength adhesives can fasten them together as shown in FIG. 3. The base 5 is formed as an elongated horizontal panel in a square-corner C-shape with one additional flange 5*b* extending perpendicularly from one of the legs of the C-shaped base. The bottom flange of the base is attached to the platform 5*a*. The shell panel 4 is flat and is attached at its top portion to the transom riser 6 which is a C-shaped panel shaped like the base riser but deeper and attached to the ceiling 7.

In assembly, the base 5 is at the bottom with the open side of the C facing towards the shaft 11 and with the additional flange 5*b* pointing up. The bottom of the shell panel 4 overlaps the additional flange 5*b* of the base 5. The transom riser 6 is at the top and its additional flange 6*b* extends downwardly to overlap the top of the shell panel 4. The seams where the panels overlap are horizontal. Decorative panels 2 are mounted between the stiffeners 3 on the shell panel 4.

The stiffeners 3 are vertical and hat-shaped sections, typically of stainless steel, which are applied vertically to the inside of the assembled panels to form the side, front and rear walls of the elevator cab. The size of front and/or rear door determine the extent of the front and rear walls. There may be as few as one and as many as four or more stiffeners 3 per wall, depending on the size of the cab and the desired appearance. As shown in FIGS. 2 and 3, the stiffeners 3 overlap the base 5, the shell panel 4, and the transom riser 6 and are fastened to each to make the assembled wall rigid. The shape and the thickness of the decorative panels 2 and the use of the stiffener 3 on the inside maximize the internal width and depth.

Figure 6:
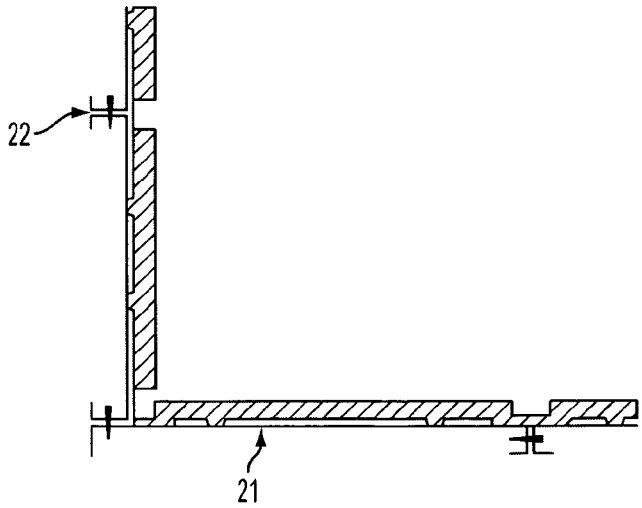
FIG. 6 is a top view of a prior art elevator cab illustrating how the shell panels have T-shaped portions extending toward the elevator shaft and that the decorative panels are mounted on the opposite side inside the cab.

FIG. 6 discloses a prior art elevator cab construction when the cab shell 21 has T-shaped stiffeners 22 which are formed from back to back L-shaped portions mounted on the outside of the cab shell and extend toward the elevator shaft 11 in contrast to the present invention. The decorative panels 23 are mounted on the interior of the panels 21.

During fabrication of the base 5 and shell panels 4, ventilation openings 14 are punched in a vertical line on the shell panel 4 where the stiffeners 3 will be placed to allow ventilation as shown in FIG. 7. Low-profile panel clips 9 are attached to the shell panel 4 where the removable decorative panels 2 will be hung. As shown in FIG. 3 holes are punched in the transom riser 6 to provide an opening for the lighting, additional ventilation and for fastening the ceiling 7 to the transom riser 6.

Removable decorative panels 2 can be of any code compliant material, including plastic laminate, wood veneer, stone, metal or glass. The panels 2 have low-profile mounting clips 9 or are otherwise prepared to hang on the shell panel 4. The decorative panels 2 are oriented vertically and fit between the stiffeners 3. The thickness of the decorative panels is approximately the same as the thickness of the stiffeners whereby the interior dimensions of the cab is advantageously decreased.

The face of the stiffeners 3 exposed to the inside of the cab are provided with a decorative finish such as paint, or made of a decorative metal such as stainless steel. One or more of the removable decorative panels 2 can be drilled for providing a handrail, which is mounted on posts to allow the handrail to be removable from inside the cab.

As shown in FIG. 3 the C-shape of the transom riser 6 is bent deeper than the thickness of the shell panels 4 and removable decorative panels 2 to present an inverted stepped cove. Light fixtures 18 are mounted outside the cab and inside the C-shaped transom riser 6. Risers 6 have lenses placed in the punched holes to allow the light to come through. The lenses are removable to allow the fixtures and bulbs to be serviced from the inside of the cab. One or more risers may have a register opening or grille to provide ventilation at the top of the cab.

Because lighting is provided on the transom risers 6, the ceiling 7 of the cab does not need to have any light fixtures. Providing adequate ventilation through the shell and riser can make a fan on the ceiling 7 unnecessary.

This design eliminates light fixtures mounted to the inside of the cab ceiling 7, thereby maximizing the internal height. By also eliminating or minimizing the number of devices mounted on the interior of the ceiling 7, this advantageous design allows for the maximum height under the crosshead beam and gussets of the cab sling.

The invention claimed is:

1. An elevator cab construction for increasing an interior cab size of an elevator cab including a platform and a ceiling, the cab construction comprising (a) shell panels forming the interior walls of said elevator cab attached to said ceiling and platform by a base and transom which base and transom are both channel-shaped and both offset from an outer perimeter of said shell panels toward the elevator interior when viewed from a top-down perspective, wherein said panels comprise a panel material;

(b) vertical hat-shaped interior stiffeners formed on said shell panels from said panel material to provide stiffening, (c) vertical corner trim stiffeners in the corners of the cab to support said shell panels, (d) decorative panels mounted on said shell panels on the interior of said cab between said vertical hat-shaped stiffeners and said vertical corner trim stiffeners;

wherein said decorative panels are approximately of a same depth as said vertical hat-shaped stiffeners;

wherein said shell panels have an opening to the elevator shaft to provide ventilation through said hat-shaped vertical stiffeners.

2. The elevator cab of claim 1 wherein said vertical stiffeners separate strips of stiff material attached vertically to said shell panels.

3. The elevator cab of claim 1 wherein said decorative panels extend inwardly from said shell panels.

4. The elevator cab of claim 1 wherein said vertical hat-shaped stiffeners are channel-shaped.

* * * * *